US005172503A

United States Patent [19]

Dane et al.

[11] Patent Number: 5,172,503

[45] Date of Patent: Dec. 22, 1992

[54] DISPLAY UNIT HAVING VERTICAL RELIEF

[75] Inventors: Mark Dane, Sharon, Mass.; Peter C. Sewell, Vancouver; Grant S. Burson, Victoria, both of Canada

[73] Assignee: Photoscape, Inc., Sharon, Mass.

[21] Appl. No.: 658,181

[22] Filed: Feb. 20, 1991

Related U.S. Application Data

[63] Continuation-in-part of Ser. No. 583,213, Sep. 14, 1990, abandoned.

[51] Int. Cl.[5] ..... G09F 7/04

[52] U.S. Cl. ..... 40/600; 40/621; 40/152.1; 40/661; 206/455

[58] Field of Search ..... 40/160, 621, 600, 594, 40/615, 620, 661, 642, 152.1; 248/467; 206/455, 503; 220/4.26, 4.27

[56] References Cited

U.S. PATENT DOCUMENTS

| | | | |
|---|---|---|---|
| 1,068,621 | 7/1913 | Abraham | 40/152 |
| 1,516,264 | 11/1924 | Bliss | 40/621 |
| 2,127,078 | 8/1938 | Zwicker | 40/152 |
| 3,384,987 | 5/1968 | Prechtl | 40/152.1 |
| 3,722,122 | 11/1971 | Sesto | 40/152 |
| 3,868,283 | 2/1975 | Scheyer | 40/160 X |
| 3,928,921 | 4/1974 | Gurman | 40/142 |
| 3,942,147 | 3/1976 | Josephson | 40/621 X |
| 4,211,382 | 7/1980 | Bonfils | 248/467 |
| 4,443,959 | 3/1982 | Ackeret | 40/152 |
| 4,471,548 | 9/1984 | Goudie | 40/610 |
| 4,852,284 | 8/1989 | Faggiano | 40/600 X |
| 4,875,654 | 10/1989 | Chandonnet et al. | 248/467 |
| 4,912,863 | 4/1990 | Harvey | 40/152 |

*Primary Examiner*—Kenneth J. Dorner
*Assistant Examiner*—Milton Nelson, Jr.
*Attorney, Agent, or Firm*—Wolf, Greenfield & Sacks

[57] ABSTRACT

A display unit for exhibiting a plurality of display materials on a parallel planes spaced relative to each other as well as relative to a wall or other surface. The display unit includes a base, securable to the surface and a plurality of substantially identical spacer elements. The spacer elements are removably securable to one another in a stackable relationship. Each spacer element includes facilities for receiving and aligning other spacer elements in registration therewith and removably securing the spacer elements to one another as well as the base. A mounting facility securable to the spacer elements includes a transparent window for exhibiting the display material. In an additional feature, the display unit base includes a reversible backing member which is removably secured thereto to provide a variety of colored or textured backgrounds upon which to exhibit the display material. Each spacer element in a stack may be identical to the other spacer elements in that stack, or it may only have one dimension that is identical to a dimension of an element directly therebelow.

15 Claims, 8 Drawing Sheets

DISPLAY UNIT HAVING VERTICAL RELIEF

CROSS REFERENCE TO RELATED APPLICATION

This application is a continuation in part of U.S. application Ser. No. 07/583,213, filed on Sep. 14, 1990, abandoned Apr. 2, 1992.

1. Field of the Invention

The present invention relates to the field of display devices for photographic prints and the like, and more particularly to an improved display unit for arranging and presenting photographs or other display material in a vertical relief manner, to create different depth perspectives for the viewer.

2. Background of the Invention

Many people enjoy creating their own decorative effect in the display of photographs, drawings and other like display materials. This decorative effect can be enhanced by varying the placement, the arrangement and depth perspective for the different display materials in a manner to suit the aesthetic tastes of the decorator. However, known display systems do not permit the easy and rapid rearrangement of the display materials to allow the decorator to try different arrangements or to vary the arrangements depending on mood, season, decor, color and changing tastes. In particular, such known display systems do not allow the user to quickly and easily adjust the spacing of the plane of the display materials with respect to a background surface or adjust the relative spacing of the planes of plural display materials with respect to one another. Also, the display materials themselves often cannot be easily changed without replacement of the apparatus in which they are mounted.

Examples of prior art devices are shown in U.S. Pat. No. 3,786,584, Holson, which discloses a planar display frame for attaching a plurality of display materials by magnetic means and U.S. Pat. Nos. 3,456,374; 3,553,872; and 4,912,864 which likewise disclose devices in which display material are attached magnetically to a frame assembly. U.S. Pat. No. 3,384,987, Prechtl, discloses a picture frame having spacing means for adjustably varying the space between the picture frame and the surface to which it is attached. U.S. Pat. No. 2,957,262, Knox, discloses a frame assembly in which a picture is disposed at an angle with respect to the plane of the outer molding of the frame, creating a tilted perspective for the viewer.

It is therefore an object of the present invention to provide a display unit which enables multiple display materials to be exhibited on different parallel planes, spaced relative to each other as well as the display unit base and the wall.

Another object of the present invention is to provide a display unit which allows multiple display materials to be exhibited in a vertical relief format to enhance user perspective.

Another further object of the present invention is to provide a display unit which allows multiple display materials to be exhibited so that the placement, depth, of the materials, may be quickly and easily varied relative to each other, and which provides easily changeable backgrounds against which to exhibit such materials.

SUMMARY OF THE INVENTION

The foregoing and other objects of the present invention are achieved with a unit in which a plurality of display materials may be displayed in planes parallel to one another, but spaced relative to each other, as well as relative to the display unit base and the surface to which it is secured. According to one embodiment of the present invention, a display unit for exhibiting display material comprises a base, which can be mounted on a flat surface, and a plurality of substantially identical spacer elements. The spacer elements are removably securable to one another in registration in a nested relationship. Typically, each of the spacer elements comprises a body capable of nesting with another of the spacer elements, and an element for selectively and removably securing the body to another one of the spacer elements or the base. Each spacer element may also include facilities for aligning adjacent spacer elements in registration therewith. This securing element typically is a magnet, although other types of devices may be used, such as hook and loop fasteners and the like. The elements can be interchangeably stacked to any desired depth.

The invention also includes apparatus for mounting the display material on selected ones of the spacer elements. Preferably, this apparatus is a transparent cover which is received by the body member of any one of the spacer elements, and is removably secured to the top most of the stacked elements.

In another aspect of the invention, the base may comprise a reversable backing member which is removably secured thereto to provide a variety of colored or textured backgrounds on which to exhibit the display material.

In a second embodiment of the invention, the spacer elements are also removably securable to one another in a nested relationship, but the stacked elements need not be identical. In this embodiment, each spacer element which is stacked on top of another spacer element has only one dimension in common with the spacer element therebelow. In a preferred embodiment each stacked spacer element is rectangular in shape, each element having two parallel sides which are longer than the other two parallel sides. The longer sides of each stacked element have a dimension which is equal to the dimension of the shorter sides of the spacer element stacked directly therebelow. As a consequence, as the spacer elements are stacked one on top of the other, each spacer element is aligned so that its longer sides are at right angles with respect to the longer sides of the spacer element directly thereunder. Typically, either one or two spacer elements can be stacked on top of the spacer element directly therebelow. The same securing elements used in the first embodiment are employed in this embodiment. However, since in some instances, more than one spacer element is stacked on top of the spacer element directly therebelow, some spacer elements require two, spaced securing elements. Moreover, typically in this embodiment, each spacer element is provided with a transparent cover and means for allowing each element to be independently displayed on a table or hung from a wall. In all other respects, the spacer elements of the second embodiment are substantially identical to the spacer elements of the first embodiment.

BRIEF DESCRIPTION OF THE DRAWINGS

The objects, advantages and features of this invention will be more clearly appreciated from the following detailed description taken in conjunction with the accompanying drawings in which.

DETAILED DESCRIPTION OF THE PREFERRED EMBODIMENT

Figure 1:
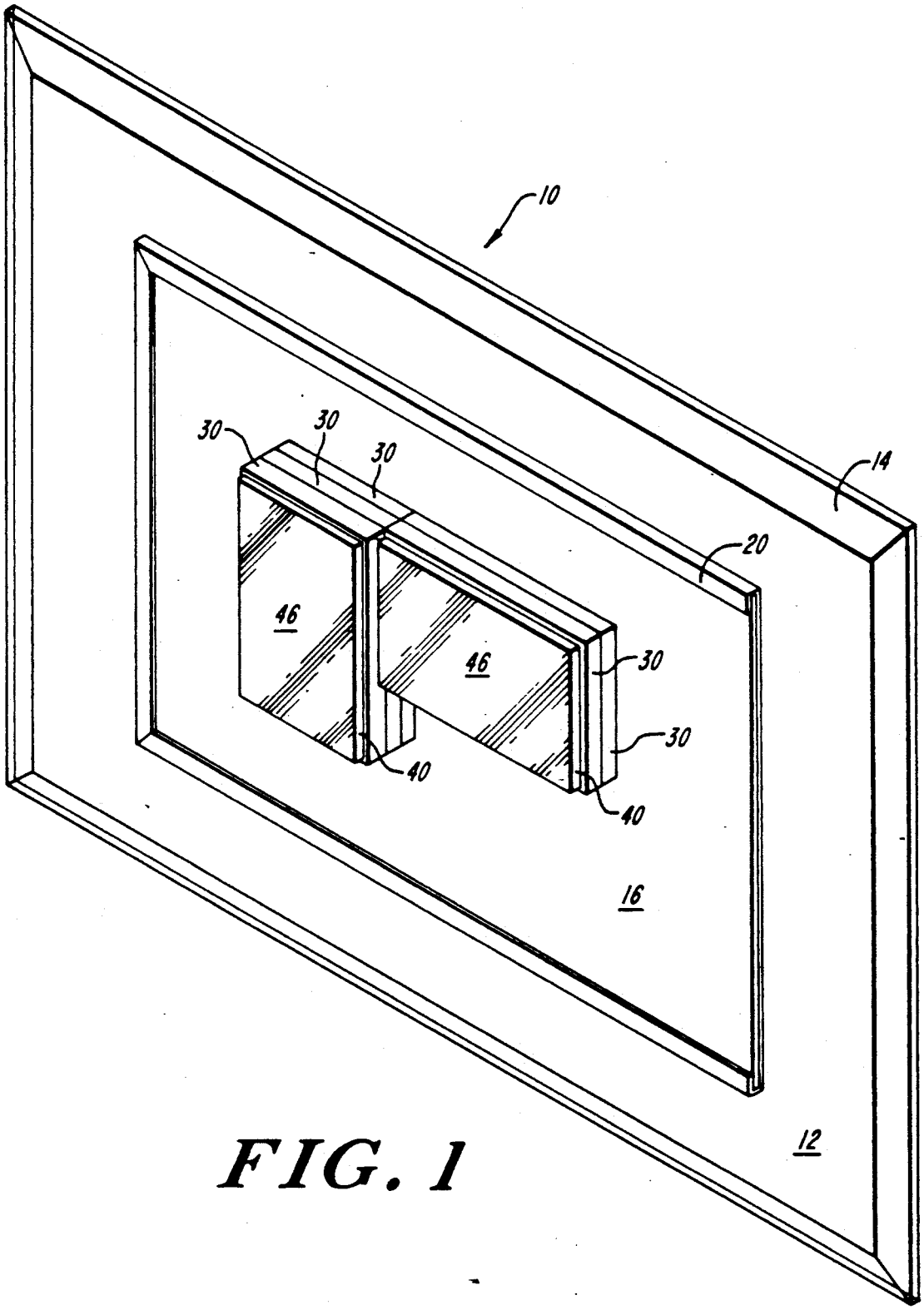
FIG. 1 is a perspective view of the frame assembly of the present invention.

With reference now to the drawings, and more particularly to FIG. 1 thereof, a display unit will be described in accordance with the present invention. Display unit 10, as shown in the drawings, is meant for attachment to any flat surface, such as a wall or other vertical surface or to a horizontal surface. Display unit 10 includes base 12, backing member 16, spacer elements 30 and mounting members 40.

As illustrated in FIG. 1, base 12 is a substantially planar, rigid member having a rectangular shape. Base 12 may be made from any rigid material such as wood, metal, glass, plastic, Plexiglass® or Lucite®. Base 12 may have a square, rectangular, diamond, circular or other shape, with the actual dimensions and shape being an obvious choice of the designer. In the embodiment illustrated in FIG. 1, the perimeter of base 12 is bevelled to enhance its aesthetic appearance.

Figure 2:
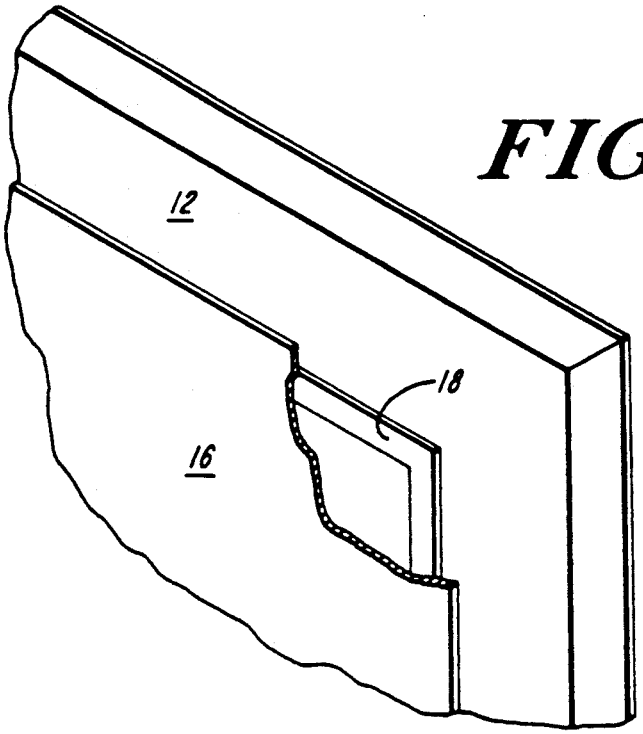
FIG. 2 is a partially cutaway view of the frame assembly of FIG. 1.

Backing member 16 is a planar, rigid member which is removably securable to base 12. The shape of backing member 16 preferably is similar to that of base 12, although a base of a different shape may be used. Backing member 16 provides a background against which display materials may be exhibited. In the preferred embodiment, backing member 16 comprises a planar metallic member which may be removably secured to base 12 such as by a magnetic strip 18, as shown in FIG. 2. In such an embodiment, backing member 16 may be laminated to have a different color and texture on each side, to provide two choices of background on which to exhibit display materials. To change the background against which display materials are exhibited, one need only remove member 16, turn it over and replace it. Backing member 16 is further secured against base 12 by an optional retainer 20, illustrated in FIG. 1.

In various alternate embodiments, backing member 16 may be removably secured to base 12 by a hook and loop-type fastener, with the complementary mating portions of the fastener being disposed on the rear surface of backing member 16 and the front surface of base 12, respectively. In still other embodiments, backing member 16 may slidably fit into retainer 20 thereby temporarily securing it against base 12.

Figure 3:
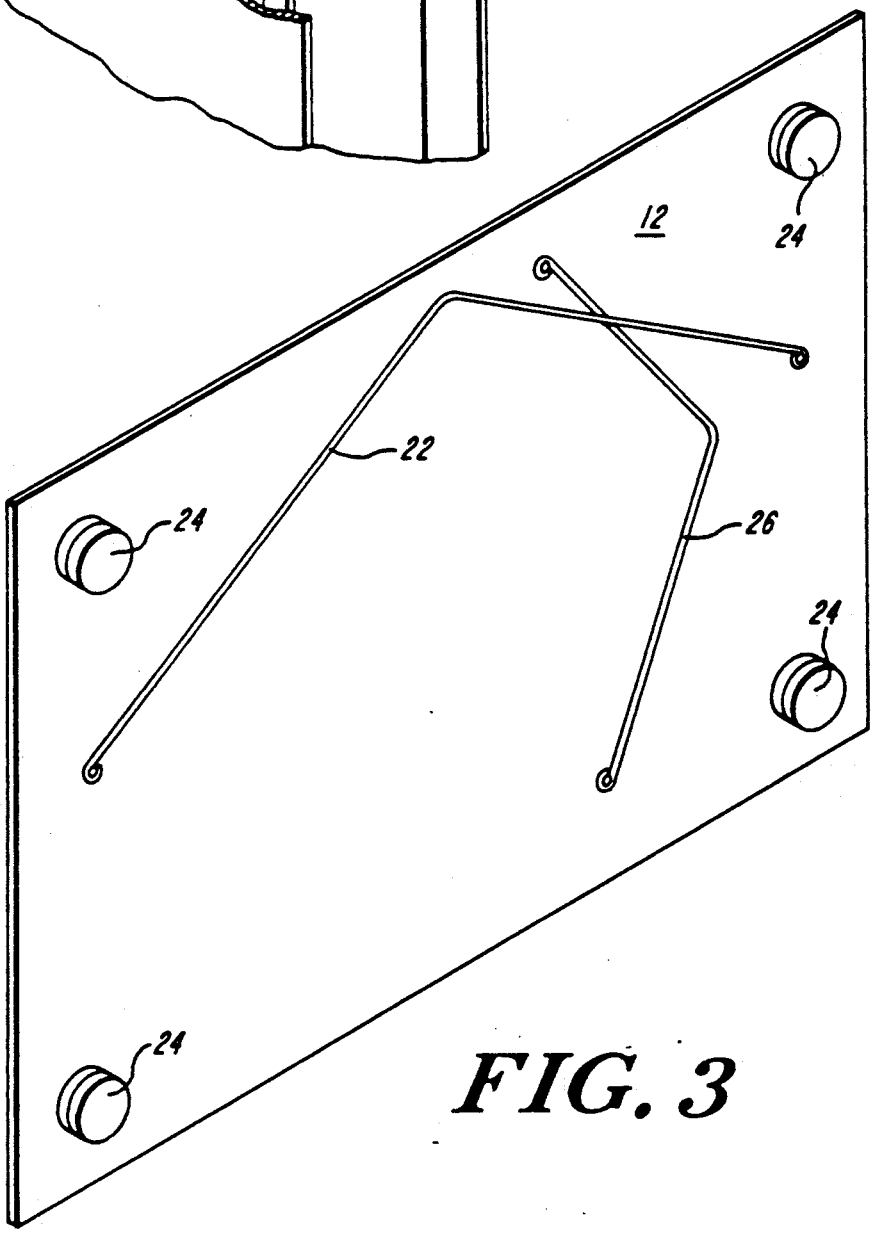
FIG. 3 is a perspective rear view of the frame assembly of FIG. 1.

Referring to FIG. 3, the rear surface of base 12 is shown illustrating hanging wires 22 and 26 and adjustable spacers 24. Wires 22 and 26 are coupled to the rear of base 12 and provide means by which display unit 10 may be hung from a hook on a wall or other flat vertical surface. Adjustable spacers 24 are coupled to base 12 at each of the base corners, as illustrated. Adjustable spacers 24 comprise, in one embodiment, a generally cylindrical element adapted to receive other such cylindrical elements in registration therewith to extend the overall length of the adjustable spacer. The length of spacers 24 determines the distance separating base 12 from the wall or other vertical for horizontal surface to which it is attached. In another embodiment, adjustable spacers 24 may be of the adjustable length peg-type illustrated in U.S. Pat. No. 3,384,987.

Figure 4:
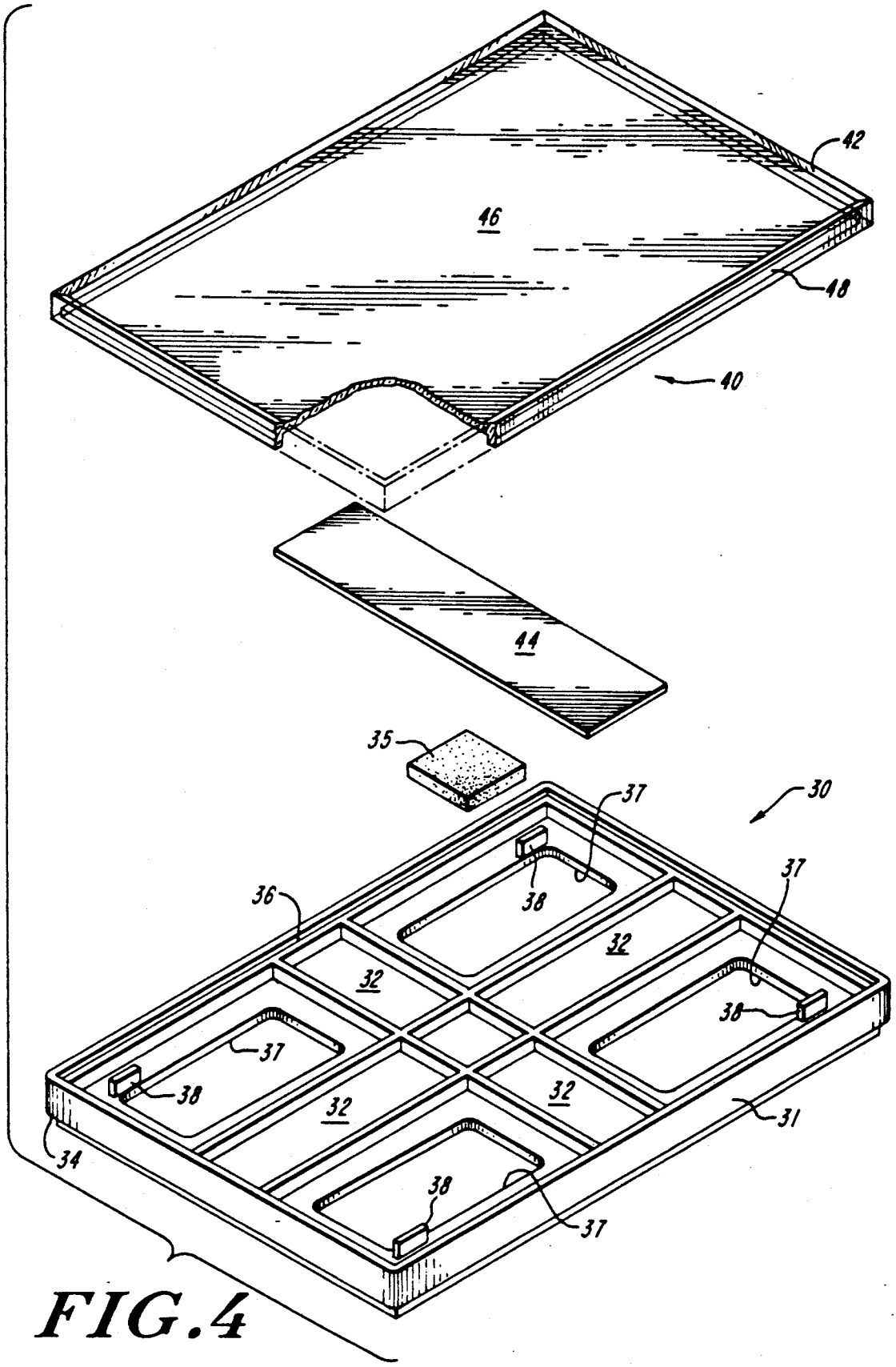
FIG. 4 is an exploded perspective view of one of the spacer elements of FIG. 1 showing its relationship to the securing and, mounting elements of the display unit.

Referring to FIG. 4, an exploded view of spacer element 30 and mounting member 40 of FIG. 1 is shown illustrating their respective components and their relationship to one another. Spacer element 30 is preferably comprised of a rigid material. If magnets are used to couple adjacent elements 30, a non magnetic material, such as plastic should be used to form elements 30. In a preferred embodiment, each spacer element 30 comprises a frame body 31, cross bars 32, magnet 35 and posts 38. Frame body 31 has a pair of cross bars 32 extending between opposite sides thereof. Cross bars 32 are integrally formed with frame body 31 and intersect each other in the center of element 30. Cross bars 32, in conjunction with frame body 31, form a plurality of apertures 37, as illustrated in FIG. 4. Apertures 37 facilitate rapid and easy separation of the spacer element 30 from mounting member 40 by insertion of a finger or other object through apertures 37 and to apply force against mounting member 40, thereby overcoming the magnetic force existing therebetween, as explained hereinafter. In an alternate embodiment, however, frame body 31 may have a substantially solid interior with no apertures present.

Figure 6:
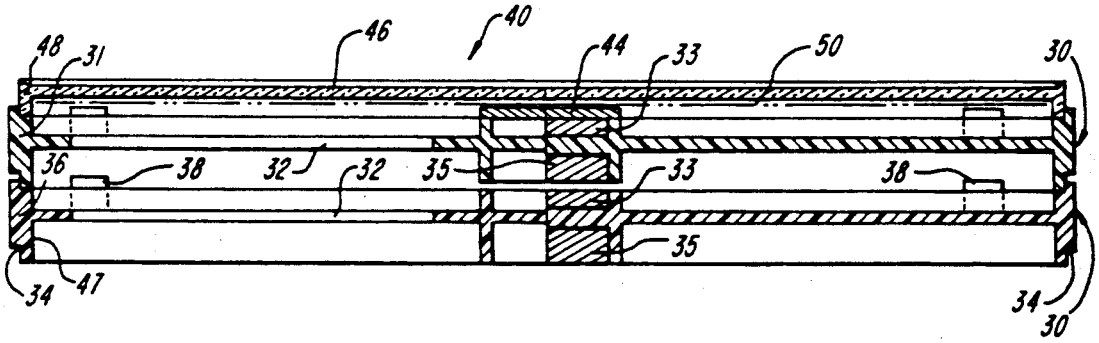
FIG. 6 is a cross sectional side view of the two spacer elements of FIG. 5 taken along line 6—6 of FIG. 5 illustrating the aligned registration therebetween.

In the preferred embodiment, a magnet 33 is secured to the top surface of cross bars 32 at the point of intersection. A similar magnet 35 is secured in a similar location on the bottom surface of cross bars 32, as illustrated in FIG. 6. Both magnets 33 and 35 should be oriented so that their north and south poles are aligned in the same direction and so that opposite poles confront one another where the magnets are most closely spaced. In an alternate embodiment, magnet 33, secured to the top surface of cross bars 32, may be replaced by a piece of ferrous metal which, in any alignment would be attracted to other magnets 35 in the immediate vicinity, such as magnet 35 in an element 30 directly thereabove in a stack. Typically, all spacer elements 30 in a stack will have the same design and structure. In another alternate embodiment, the inner section of cross bars 32 may contain an aperture in which a single magnet is disposed rather than the two magnets illustrated in FIG. 6. In this embodiment, the north and south poles of the magnets are disposed on opposite sides of element 30, so that when elements 30 are stacked in a proper relationship, the north pole end of the magnet always is in confronting relation with the south pole of a magnet of an adjacent element and vice versa.

Magnets 33 and 35 are preferably a planar synthetic resinous material having magnetized metallic particles therein. Magnets 33 and 35 secure spacer element 30 to other spacer elements and background 16, as explained hereinafter.

Figure 5:
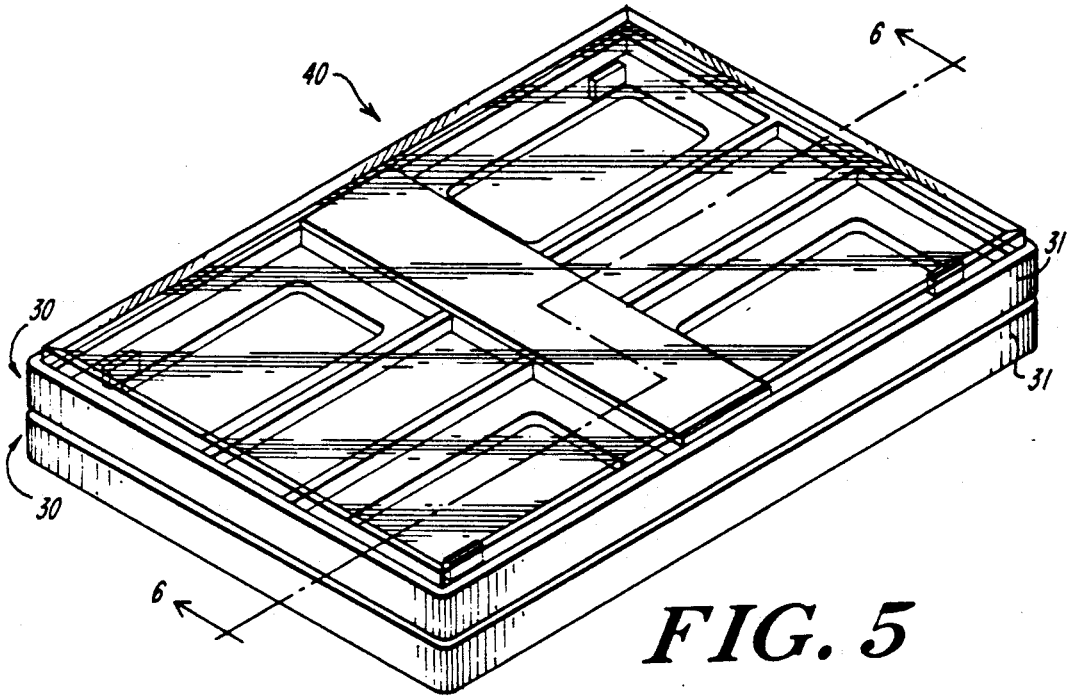
FIG. 5 is an unexploded perspective view of the spacer element of FIG. 4 in a stacked relationship with another such spacer element.

The top, interior perimeter of frame body 31 has a ridge which forms a shoulder 36. The bottom, exterior perimeter of frame 31 contains a L shaped indentation 34 which may be received by a shoulder 36 of another spacer element 30. In this manner, shoulder 36 and L-shaped indentation 34 form complimentary mating surfaces which allow the frame bodies 31 of plural spacer elements 30 to be aligned in registration with each other when nested. Such a registration allows spacer elements 30 to be stacked, as shown in FIG. 5–6, in any order thereby providing a means for easily varying the distance from background 16 and the display material 50, as explained hereinafter.

When two or more spacer elements 30 are stacked in registration, their respective magnets 33 and 35 create a magnetic field therebetween which is sufficient to maintain the spacer elements removably secured with each other, while still allowing ease of separation. Typically, as shown in FIG. 6 magnet 35 is spaced slightly from magnet 33 of an adjacent element 30. This result is produced by recessing magnet 33 from shoulder 36 of element 30. The bottom most spacer element 30 of a stack of spacer elements is secured to background 16, in the preferred embodiment, by the attraction of its respective magnet 35 to the metallic planar member of background 16. Magnet 35 preferably is flush with edge 47 of indentation 34 and thus with background 16. The poles of magnets 33 and 35 are disposed in elements 30 so that opposite poles attract one another when the spacer elements are properly aligned, as described. As a result, the spacer elements can be stacked with only one orientation in which the indentation 34 of the upper spacer element rests against the shoulder 36 of the lower spacer element. The plurality of the spacer elements 30 thus may be rapidly and easily aligned in stacked registration with each other in only the proper configuration.

In an alternate embodiment, magnets 33 and 35 of element 30 may be replaced by a hook and loop type fastener or other like means with the complimentary mating portions of the fastener disposed on the top and bottom surfaces of frame body 31 and/or background member 16.

In another embodiment, the frame bodies 31 of spacer elements 30 may be manufactured with exact tolerances to enable the edge 47 of one spacer element to snap fit with the shoulder 36 of an adjacent spacer element, allowing the spacer elements to be rapidly and easily aligned in stacked registration with each other.

Referring again to FIG. 4, mounting member 40 comprises a transparent window 46 and a retention bar 44. Window 46, is preferably made from a rigid, transparent material, such as hard plastic, glass, Lucite®, or Acrylic, etc, through which the display material 50 may be viewed. Window 46 has a shape similar to frame body 31 of spacer element 30. Window 46 includes a wall 48 projecting downwardly from its top surface to create a rectangular cavity in which the display material 50 may be retained. Window 46 may optionally have a bevelled edge 42 disposed about its top exterior perimeter. Referring to FIGS. 4–6, window 46 is sized be received within a frame body 31 and be disposed adjacent to shoulder 36 so as to be maintained frictionally therein. In this manner, shoulder 31 may receive either the L shaped indentation 34 of another spacer element 30 or window 46 of mounting member 40. Thus, elements 30 are interchangeable so that any one can be placed in the top, bottom or a middle position.

Retention bar 44 preferably is a planar metal strip which is attracted to the magnet 33 of spacer element 30 and sized to frictionally engage or be secured to wall 48 of window 46. Retention bar 44 maintains display material 50 within window 46 and, in conjunction with posts 38 of spacer element 30, provides a means for supporting the display material within window 46, so that it is flush with the receiving surface of window 46. The use of retention bar 44 allows display material 50 to be easily replaced, and allows material 50 and window 46 to be quickly and easily transferred to another stack of elements 30. Window 46 may be provided with frictional engaging surfaces along its lateral edges to facilitate its grasping and removal.

Referring to FIGS. 5 and 6, two spacer elements 30 are illustrated in stacked relation. The bottom spacer element is secured to background member 16 (not shown) by its lower magnet 35 The L shaped indentation 34 of the top spacer element rests on the shoulder 36 of the bottom spacer element, as illustrated. The opposed magnets 33 and 35 of the top and bottom spacer elements are attracted to one another to secure the spacer elements in stacked registration with each other. Wall 48 of window 46 rests on shoulder 36 of the top spacer element 30. Retention bar 44 is magnetically attracted to the top magnet 33 of the top spacer element 30 to secure mounting member 40 thereagainst. The display material 50 is disposed intermediate retention bar 44 and window 46 as illustrated by the broken dashed line in FIG. 6.

In the present invention, display material 50 may comprise a photograph, as in the preferred embodiment, or may be any printed or other substantially planar media capable of fitting within the dimensions of transparent window 46 of mounting member 40.

Figure 7:
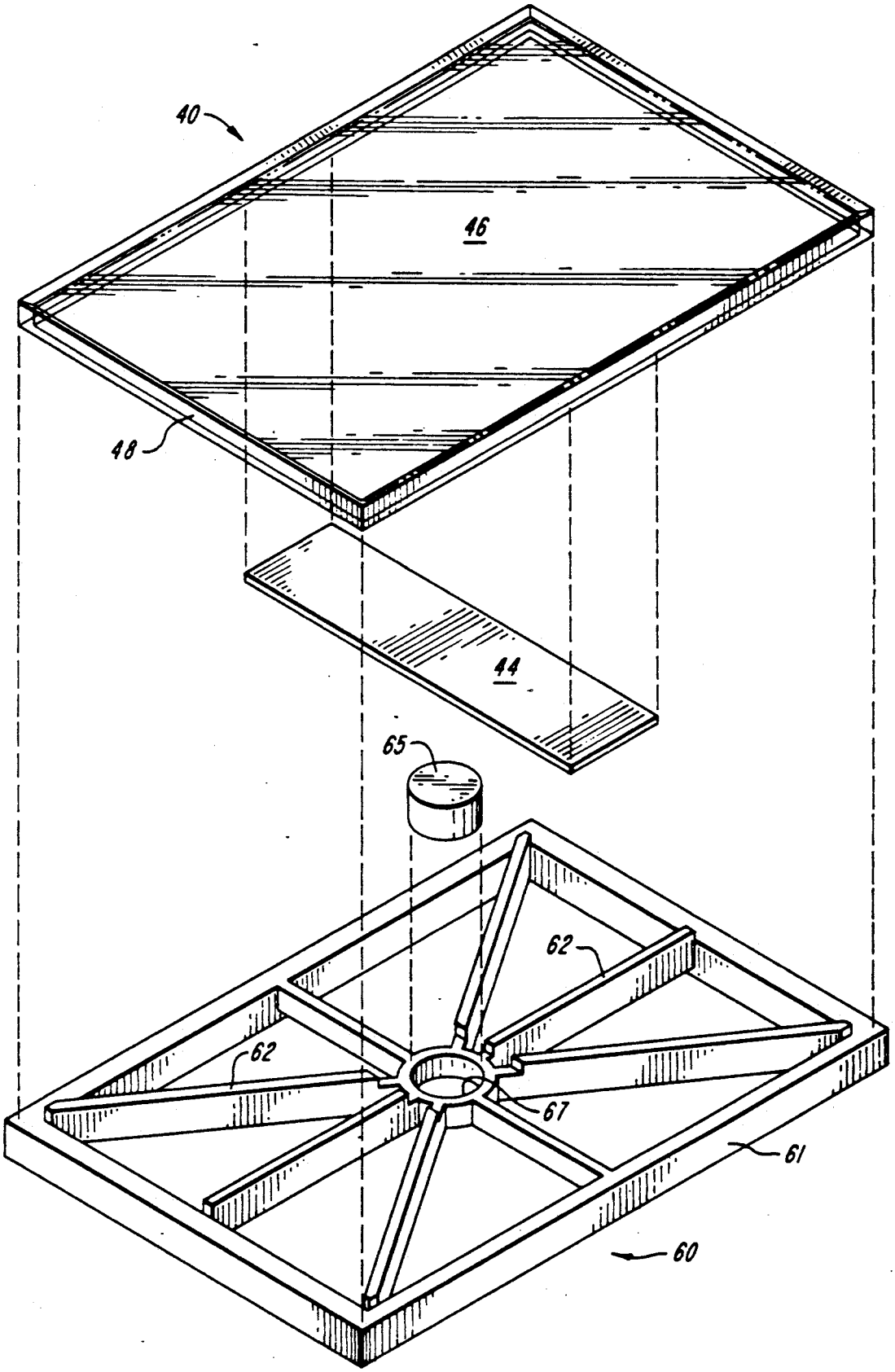
FIG. 7 is an exploded perspective view of an alternate embodiment of one of the spacer elements of FIG. 1 showing its relationship to the securing and mounting elements of the display unit.
Figure 8:
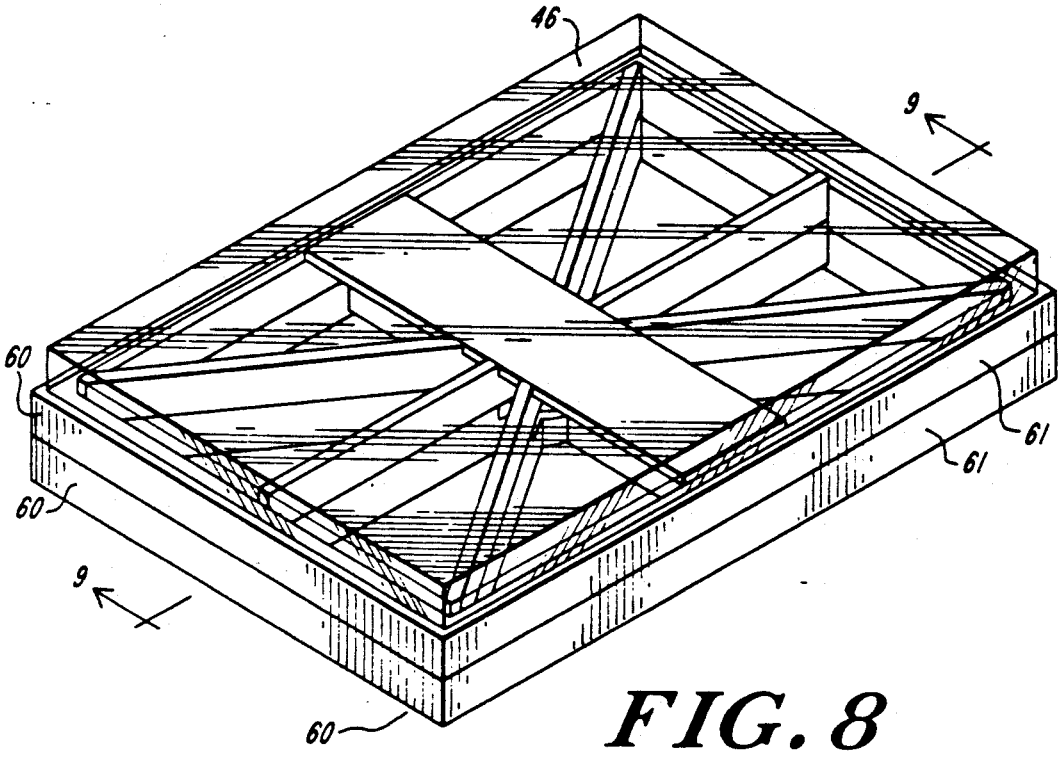
FIG. 8 is an unexploded perspective view of the spacer element of FIG. 7 in a stacked relationship with another such spacer element.
Figure 9:
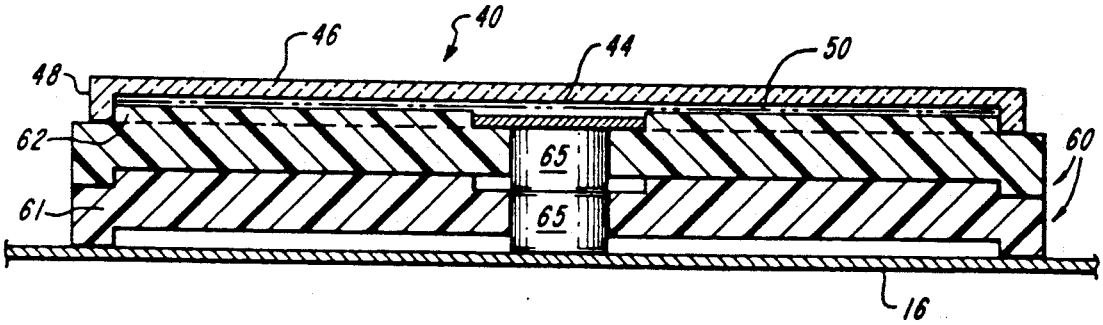
FIG. 9 is a cross-sectional side view of the two spacer elements of FIG. 8 taken along line 9—9 of FIG. 8 illustrating the aligned registration therebetween.

Referring to FIGS. 7–9, an alternate embodiment of the spacer element is illustrated. In this embodiment, spacer element 60 is substantially similar in shape to spacer element 30 except that the frame body 61 is shaped to include six cross bars 62 which project radially from a circular aperture 67. A cylindrically shaped magnet 65 similar to a magnet 35 of the preferred embodiment, is received in aperature 67. Also, referring to FIG. 9, the ribs 62 project upwardly from the top surface of frame body 61 thereby forming an intermitant shoulder 68 which is capable of receiving the mounting member 40 or the bottom of another spacer element 60, as illustrated in FIG. 9. In the alternate embodiment, frame 61 of spacer element 60 has a downward projection 64 which may rest against either backing member 16 or the top surface of frame body 61 of another spacer element 60. Mounting member 40 remains the same as before except the dimensions of window 46 and wall 48 are adjusted accordingly to accommodate a frame body 61.

Referring to FIGS. 8 and 9, two spacer elements 60 are illustrated in stacked relation. The bottom spacer element is secured against background member 16 by its respective magnet 65. The top spacer element 60 is disposed adjacent to the bottom spacer element similar to the preferred embodiment. The spacer elements 60 are secured to one another by their respective magnets 65. The respective magnets of the spacer elements 60 are disposed opposite and adjacent to one another as illustrated in FIG. 9. In addition, magnet 65 of the lower spacer element 60 is flush against backing member 16. Mounting member 40 is secured against the top spacer element 60 by the magnetic attraction of retention bar 44 to magnet 65 thereof. The display material 50 is disposed, as before, intermediate retention bar 44 and window 46.

FIGS. 5-6 and 8-9 illustrated only two spacer elements 30 and 60, respectively in stacked relationship. It is obvious to those skilled in the art that stacks of spacer elements may range from between 1 to 6 or more without affecting the relationship to the other spacer elements, backing member 16 or mounting member 40.

A display unit 10 as disclosed in the illustrated embodiment provides means in which a plurality of display materials may be exhibited on parallel planes which are different from each other and from that of backing member 16 and base 12. Using a plurality of photographs, spacer elements 30 and mounting members 40, the photographs may be displayed in a vertical relief manner as desired by the user. For instance, a first photograph may be mounted in a mounting member 40 and secured adjacent the top spacer element of a stack of four spacer elements aligned in registration with each other and secured to backing member 16. A second photograph may be mounted in a mounting member 40 and secured adjacent the top spacer element of a stack of only two spacers elements aligned registration with each other and secured to backing member 16. Still another photograph may be mounted in a mounting member 40 and secured adjacent a single spacer element 30 which is secured to background 16. In this manner, the photographs may be displayed on different planes which are spaced from one another and which are generally parallel to each other and to background member 16 on base 12.

The photographs or display materials may be easily inserted or removed from mounting member 40, and mounting member 40 may be easily secured or removed from a stack of spacer elements 30. The uniform design or dimensions of the spacer elements allows them to be stacked in any order, eliminating the requirement for a specific sequential configuration among the elements. Further, the positions of the stacks of spacer elements 30 may vary over the entire area of backing member 16. In this manner, display material 50 may be exhibited at any point on background member 16 and with its distance from the display material and the background 16 being completely variable, the only limitation being the number of spacer elements provided with the display unit. Further, in the preferred embodiment, the backing member 16 may be reversed so that a second background pattern and/or texture is available for use.

Spacer elements 30 may have uniform dimensions, or may be divided into individual sets of spacer elements, with each set dimensioned to receive a different sized display material. For example, a first set of spacer elements may be designed to receive a 4"×6" photograph. Still photograph. A second set of spacer elements may be designed to receive a 3½"×5" photograph. Still another set of spacer elements may be dimensioned to receive a 5"×7" photograph. In this manner, different sized display materials may be displayed with their position on backing member 16 as well as their distance from backing member 16 being completely variable.

Figure 10:
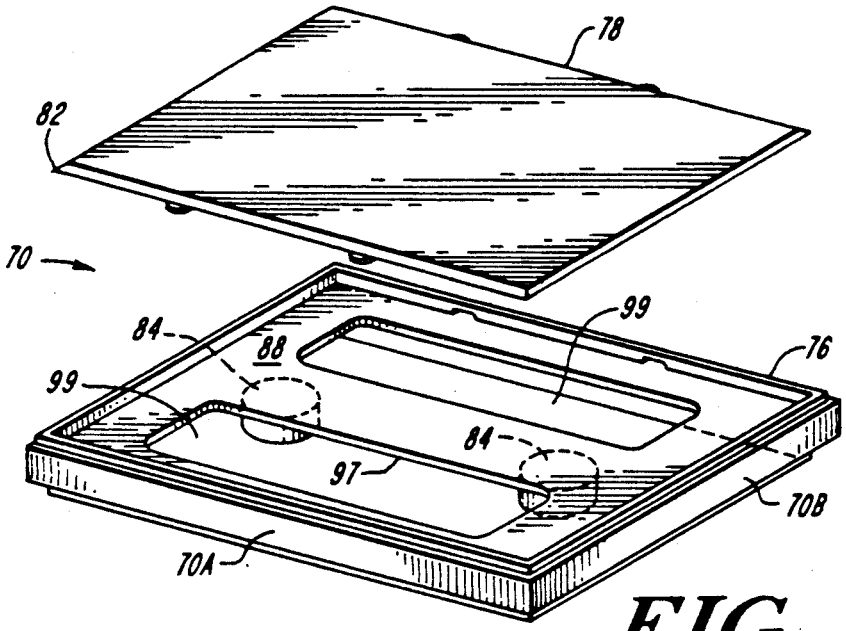
FIG. 10 is a perspective view of another embodiment of a spacer element of this invention.
Figure 11:
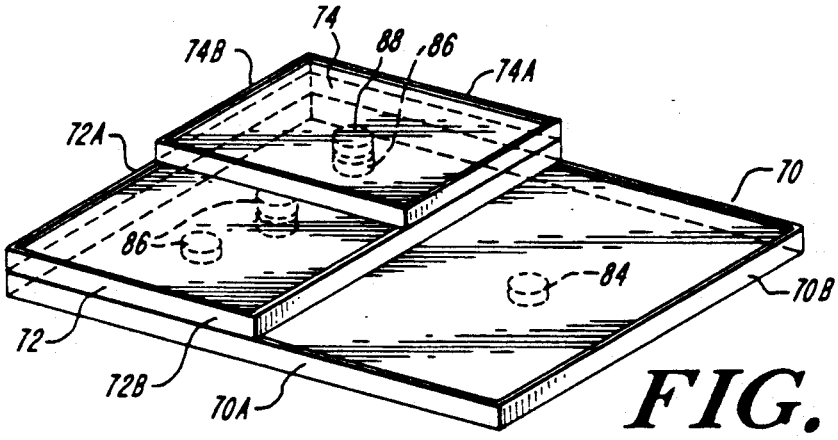
FIG. 11 is a perspective view of a plurality of spacer elements in stacked relation.

Another embodiment of the present invention will now be described with particular reference to FIGS. 10-13. Like numbers are used for like parts, where possible. In this embodiment, each of the spacer elements is not necessarily identical to all other spacer elements, and a plurality of different size spacer elements 70, 72 and 74 is provided. Each spacer element need only have one dimension which is identical to that of the spacer element directly therebelow. Two, opposed sides of one element must be generally parallel to two sides of an element directly therebelow and these two sides must be spaced the same distance as those same two sides on the element directly therebelow. In this manner, the two sides on the upper element nest with and are in registration with the two opposed sides of the element below. The stacked elements need not have the same shape. For example, a square or rectangular element could be designed to nest with a hexagonal-shaped element. Preferably, however, the elements are all rectangular, as will be described. Spacer elements 70, 72 and 74 may have the structure of either spacer elements 30 or spacer elements 60, or the structure shown in FIGS. 10-13. For purposes of illustration only, as shown in FIG. 11, this embodiment will be described with respect to three different, stackable spacer elements. However, it is to be understood, that any number of different, stackable spacer elements may be utilized, the only limitation being the size requirements for photographs and other display material.

Figure 13:
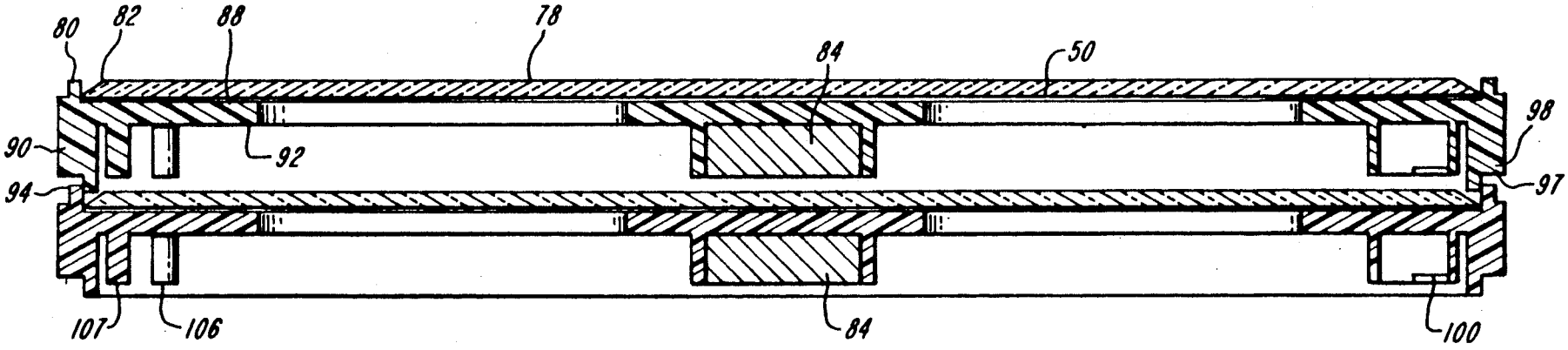
FIG. 13 a cross-sectional side view showing a plurality of the spacer elements of FIG. 10 in stacked relation.

As shown in FIG. 11, in a preferred embodiment each spacer element 70, 72 and 74 has a rectangular shape, with two parallel sides 70A, 72A and 74A having a greater length than the other two respective parallel sides 70B, 72B and 74B. Sides 70A, 72A and 74A are generally orthogonal to respective sides 70B, 72B and 74B. Referring now to FIGS. 10 and 13, each element 70, 72 and 74 has a substantially planar, rigid, rectangular base 76 which is made from any rigid material such as wood, metal, glass, plastic, plexiglass or lucite. Base 76 typically has a central member 97 extending parallel to sides 70A, 72A or 74A and defining an opening 99 on each side of member 97. Base 76 has an upper 88 and a lower surface 92. Disposed about the perimeter of upper surface 88 is a shoulder 80. Disposed about the perimeter of lower surface 92 is another shoulder 90 with a projection 94 which together define a lower cavity.

Spacer elements 70, 72 and 74 are stackable such that the largest element 70 is on the bottom, the next largest element 72 is stacked on top of element 70, while the smallest element 74 is stacked on top of element 72. So that the elements nest properly, the length of sides 72A is equal to the length of sides 70B and the length of sides 72B is equal to the length of sides 74A. In this manner, when elements 70, 72 and 74 are stacked in a nested relationship, sides 72A are parallel to sides 70B and sides 74A are parallel to sides 72B. While in FIG. 11 only one element 72 or 74 is shown stacked on top of the element 70 or 72 directly therebelow, it is to be understood that two elements 72 may be stacked on top of element 70, while two elements 74 may be stacked on top of each element 72. Also, while FIG. 11 shows element 72 disposed at one end of element 70 and element 74 at one end of element 72, it is to be understood that when only one element is stacked on top of another, it can be disposed at either end of the element therebelow.

In contrast to elements 30 and 60, each element 70, 72 and 74 preferably includes a removable, transparent window 78, which is preferably made from a rigid, transparent material, such as hard plastic, glass, lucite or acrylic etc. through which display material 50 may be viewed. As with elements 30 and 60, window 78 has a shape similar to that of its associated element 70, 72 or 74. Window 78 is sized to be received within upper shoulders 80 of elements 70, 72 and 74 and to have its edges be disposed closely adjacent to shoulders 80 so that window 78 is maintained frictionally therein. Preferably, window 78 has a bevelled edge 82 disposed about its top exterior perimeter. Display material 50 is captured between the upper surface 88 of each element 70, 72 and 74 and window 78.

Each element 70, 72, and 74 includes means for securing together the stacked element 70, 72 and 74. In a preferred embodiment, magnets are used, as with elements 30 and 60. In contrast to elements 30 and 60, in the embodiment of FIGS. 10–13, a plurality of magnets is preferred. With respect to element 70, typically two magnets 84 are used, one disposed at each end of element 70, as shown in FIGS. 10 and 11. In this manner, two elements 72 can be positioned on top of element 70 or an element 72 can be positioned at either end of element 70. Preferably, element 72 includes three magnets 86, one at each end and one in the middle. In this manner, one magnet 86 can be positioned in direct alignment with a magnet 84 therebeneath, while the magnet 86 at each end of element 72 can be aligned with a magnet 88 disposed in element 74. In this manner an element 74 can be placed at either end of element 72 or at both ends thereof. In this embodiment, only one magnet 88 is required for element 74. Typically magnet 88 is disposed directly in the center of element 74 and is positioned to lie over one of magnets 86 in element 72. However, it is to be understood, that if additional elements are to be stacked on top of element 74, two more magnets will be required, one at each end of element 74. Magnets 84, 86 and 88 are positioned within the lower cavity defined by shoulder 90 on the lower surface 92 of element 70, 72 and 74.

When elements 70, 72 and 74 are stacked, as shown in FIG. 13, projections 94 slide inside shoulder 80 and rest on the bevelled edge 82 of window 78 on the upper element. Surface 98 of cutout 97 rests on shoulder 80 on the lower element 70, 72 and 74. Each element 70, 72 and 74 has the sam identical structure all around the perimeter thereof, so that elements 70, 72 or 74 nest in proper registration with one another. The lower surface of magnets 84, 86 and 88 is recessed just slightly from the outer edge of projection 94 so that the lower surface of the magnet is either in contact with the upper surface of window 78, or spaced slightly therefrom and so that the lower surface of magnets 84 rest on or are slightly spaced from backing member 16. Elements 70, 72 and 74 can be stacked, as shown in FIG. 11, or they can be placed on backing member 16 separately and independently in any desired arrangement.

Figure 12:
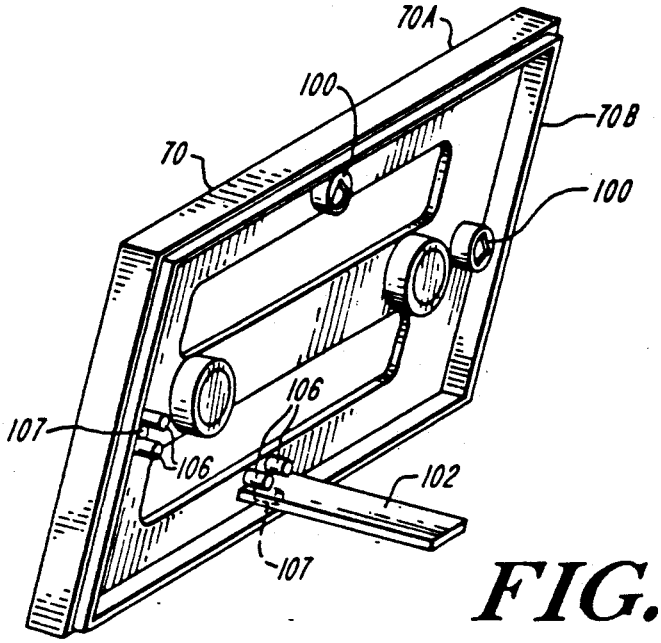
FIG. 12 is a rear perspective view of the spa element of FIG. 10.

FIG. 12 illustrates two other embodiments of this invention. While FIG. 12 shows an element 70 for purposes of illustration only, it is to be understood that elements 72 and 74 could have the same features as shown for element 70 in FIG. 12. In a first embodiment, a plurality of receptacles 100 is provided, one along a side 70B and another along a side 70A. These receptacles each have a cavity and a V shaped edge which permits element 70 to be independently hung from a hook on a wall in a manner known to those skilled in the art. Typically, receptacles 100 are disposed on lower surface 92 and the V shaped edge is flush with the lower edge of projection 94.

In a further embodiment as shown in FIG. 12, each element 70, 72 and 74 may be provided with a stand 102 which allows the elements to be independently supported as a picture frame on a flat, horizontal surface, if desired. When not in use, stand 102 may be stored on the backside of an associated element 70, 72 and 74 by use of a clip or pocket (not shown). Three spaced projections 106 and 107 are disposed on a side 70A and on a side 70B of element 70. Projection 107 is positioned adjacent shoulder 90 on lower surface 92, while the other two projections 106 extend from lower surface 92 at a location spaced from projection 107. Projections 106 are aligned parallel to shoulder 90 and are disposed on a side of projection 107 opposite of shoulder 90. When it is desired to employ stand 102 to support an element 70, 72 and 74, stand 102 is retrieved from its stored position, and is inserted between projections 106 and 107, as shown in FIG. 12. Stand 102 can be formed of any generally rigid, reinforced material which can support the weight of elements 70, 72 and 74. Typically, it is formed of a molded plastic material.

In all other respects, this embodiment is identical to the previously described embodiments of this invention.

While preferably each element 70, 72 and 74 is provided with a window 78 installed when stacked, it is to be understood, that if desired, window 78 can be removed prior to stacking. Respective magnets 84, 86 and 88 serve to retain element 70, 72 and 74 in a stacked condition, as well as to allow them to be mounted onto backing member 16. When not stacked, each element 70, 72 and 74 can serve as an independent picture frame by hanging from receptacle 100, or by being supported on a horizontal surface by stand 102. It is also to be understood that other securing means besides magnets 84, 86 and 88 may be used, as previously described. This stacking arrangement permitted by element 70, 72 and 74 allows multiple pictures to be stacked on top of one another and still be visible in any desired arrangement or orientation.

It will be obvious to those reasonably skilled in the art that various alterations to the exemplary embodiment may be made without departing from the scope and spirit of the invention. For example, in addition to those already listed, various means may be used to secure spacer elements 30 to one another as well as to the backing member 16. Also, in an alternate embodiment, mounting member 40 may be eliminated completely if the display material 50 is rigid enough to frictionally engage the frame body 31 of the topmost spacer element. Further, the display unit 10 may be provided with multiple backing members 16, each being reversible, to provide yet an even broader range of backgrounds for exhibiting the display materials 50. Various other alterations and changes may be made to spacer elements 30 and mounting members 40 to accommodate the particular display materials desired.

In view of the above description, it is likely that other modifications and improvements will occur to those skilled in the art which are within the scope of this invention. The above description is intended to be exemplary only, the scope of the invention being defined by the following claims and their equivalents.

What is claimed is:

1. A display unit for exhibiting display material comprising:

a unitary base, at least partially formed of metal, and having means for securing said base against a flat surface;

a plurality of spacer elements removably securable to one another in stacked relation on said base, each of said spacer elements comprising:

a body member capable of receiving another of said spacer elements in stacked relation; and magnetic means, coupled to said body member, for selectively removably securing said body member to other adjacent ones of said spacer elements and said base;

means for mounting display material within the body member of at least one of said spacer elements;

a substantially rigid, transparent window member removably securable to the body member of said one spacer element and substantially covering said display material, said window member having a generally planar upper surface; and means for frictionally retaining said window member within said body member, said retaining means permitting the removal of said window member by application of force in a direction generally perpendicular to said planar upper surface thereof.

2. The display unit of claim 1 wherein each of said spacer elements further comprises means for aligning adjacent spacer elements in registration with one another.

3. The display unit of claim 1 wherein said display material is a photograph.

4. The display unit of claim 1 wherein said base further comprises means for variably adjusting the distance between said base and flat surface to which it is removably secured.

5. The display unit of claim 1 wherein said base further comprises a background member removably secured to said base.

6. The display unit of claim 5 wherein said background member is slidably secured within said base.

7. The display unit of claim 5 wherein said background member is at least partially formed of metal and wherein said base further comprises means for magnetically securing said background member thereto.

8. The display unit of claim 5 wherein said spacer elements may be removably secured to any portion of said background member.

9. The display unit for exhibiting display material comprising:

a base having means for securing said base against a non-horizontal, flat surface;

a plurality of substantially identical spacer elements removably securable to one another in registration in a stack, each of said spacer elements comprising:

a body member;

means disposed on said body member for aligning adjacent, stacked spacer elements in registration therewith; and magnetic means, coupled to said body member, for selectively removably securing said body member to other adjacent ones of said spacer elements and said base;

means for mounting display material within the body member of one of said spacer elements; and a substantially rigid, transparent window member removably securable to the body member of said one spacer element and substantially covering said display materials so as to prevent direct contact with the display material.

10. The display unit of claim 9 wherein said base further comprises a background member upon which said spacer elements are mounted, said background member being removably mounted to said base.

11. A display unit for exhibiting display material comprising:

a base having means for securing said base against a flat surface;

a first spacer element removably securable to other spacer elements in stacked relation and removably securable to said base, said first spacer element having a generally rectangular shape, with a first pair of parallel sides and a second pair of parallel sides, said first sides being longer than and orthogonal to said second sides;

a second spacer element removably securable to said first spacer element and to other spacer elements in stacked relation, said second spacer element having a generally rectangular shape with a first pair of parallel sides and a second pair of parallel sides, said first sides being longer than and generally orthogonal to said second sides, said first sides of said second spacer element being generally equal in length to said second sides of said first element;

a third spacer element removably securable to said second spacer element and to other spacer elements in stacked relation, said third spacer element having a generally rectangular shape with a first pair of parallel sides and a second pair of parallel sides, said first sides being longer than and generally orthogonal to said second sides, said first sides of said third spacer element being generally equal in length to said second sides of said second spacer elements;

means disposed on said first and said second spacer elements for permitting said second element to nest with said first element whereby said first sides of said first element are aligned generally parallel to said second sides of said second element;

means disposed on said second and said third spacer element for permitting said third spacer element to nest with said second spacer element whereby said first sides of said second spacer element are aligned generally orthogonal to said first sides of said third element; and means disposed on said first and said second and said third spacer elements for removably securing together said first and said second and said third spacer elements and for removably securing said first and said second and said third spacer elements to said base.

12. The display unit of claim 11 wherein each of said spacer elements further comprise a face receiving a substantially rigid, transparent window removably disposed thereon; and means for retaining said window in place on said face of said spacer element whereby display material is captured between said window and said face of said element.

13. The display unit of claim 11 wherein said securing means each comprise at least one permanent magnet.

14. The display unit of claim 11 further comprising means for independently supporting each of said spacer elements on a generally horizontal surface whereby a selected one of said first and said second sides is oriented in a generally vertical position.

15. A display unit for exhibiting display material comprising:

a base, at least partially formed of metal, and having means for securing said base against a flat surface;

a plurality of spacer elements selectively removably securable to said base and to one another in stacked relation, each of said spacer elements comprising:

a body member capable of receiving another of said spacer elements in stacked relation therewith, said body member including means for aligning adjacent spacer elements in registration with one another, magnetic means, coupled to said body member, for selectively and removably securing said body member to other adjacent ones of said spacer elements and said base, means for receiving and removably mounting display; and a transparent window member removably securable to the body member of said one spacer element and substantially covering said display material and means for frictionally retaining said window member within said body member.

* * * * *